US010987823B2

(12) United States Patent
Simm

(10) Patent No.: US 10,987,823 B2
(45) Date of Patent: Apr. 27, 2021

(54) PORTABLE MACHINE TOOL

(71) Applicant: Robert Bosch GmbH, Stuttgart (DE)

(72) Inventor: Robert Simm, Oekingen (CH)

(73) Assignee: Robert Bosch GmbH, Stuttgart (DE)

( * ) Notice: Subject to any disclaimer, the term of this patent is extended or adjusted under 35 U.S.C. 154(b) by 158 days.

(21) Appl. No.: 15/321,985

(22) PCT Filed: May 5, 2015

(86) PCT No.: PCT/EP2015/059785

§ 371 (c)(1),
(2) Date: Dec. 23, 2016

(87) PCT Pub. No.: WO2015/197241

PCT Pub. Date: Dec. 30, 2015

(65) Prior Publication Data

US 2017/0129129 A1 May 11, 2017

(30) Foreign Application Priority Data

Jun. 25, 2014 (DE) ..... 10 2014 212 160.4

(51) Int. Cl.
*B27C 1/10* (2006.01)
*B25F 5/00* (2006.01)

(52) U.S. Cl.
CPC ..... *B27C 1/10* (2013.01); *B25F 5/003* (2013.01)

(58) Field of Classification Search
CPC ..... B27C 1/10; B25F 5/00
USPC ..... 30/475–477; 144/117.4
See application file for complete search history.

(56) References Cited

U.S. PATENT DOCUMENTS 1,608,920 A * 11/1926 Anderson ..... B27C 1/10 125/3
2,871,897 A * 2/1959 Hesse et al. ..... B27C 1/10 30/475
3,253,624 A 5/1966 Fegan et al.
4,066,111 A * 1/1978 Klebe, Jr. ..... B27G 13/04 30/475

(Continued)

FOREIGN PATENT DOCUMENTS

CH 472 948 A 7/1969
CN 201677304 U 12/2010

(Continued)

OTHER PUBLICATIONS

International Search Report corresponding to PCT Application No. PCT/EP2015/059785, dated Jul. 13, 2015 (German and English language document) (7 pages).

*Primary Examiner* — Jason Daniel Prone
(74) *Attorney, Agent, or Firm* — Maginot, Moore & Beck LLP

(57) ABSTRACT

A portable machine tool, in particular a hand-held planing machine, includes at least one workpiece positioning unit and at least one insert tool unit. The at least one workpiece positioning unit has at least one workpiece positioning surface. The at least one insert tool unit projects at least partially over the at least one workpiece positioning surface in order to permit processing of workpiece. The portable machine tool further includes at least one adjustment unit that is configured, in at least one state, to set at least one orientation of one or more of the insert tool unit and the workpiece positioning surface relative to one another.

16 Claims, 3 Drawing Sheets

(56) References Cited

U.S. PATENT DOCUMENTS

| | | | | | |
|---|---|---|---|---|---|
| 4,335,768 | A * | 6/1982 | Bachmann | B27C 1/10 | 30/475 |
| 4,360,048 | A * | 11/1982 | Schadlich | B27C 1/10 | 30/475 |
| 4,363,343 | A * | 12/1982 | Cuneo | B23Q 9/0028 | 30/475 |
| 4,382,729 | A * | 5/1983 | Bachmann | B27C 1/10 | 30/475 |
| 4,433,710 | A * | 2/1984 | Posta | B27C 1/10 | 30/475 |
| 4,442,878 | A * | 4/1984 | Moriguchi | B27F 5/026 | 30/475 |
| 4,693,648 | A * | 9/1987 | Cavedo | B27C 1/10 | 144/117.4 |
| 5,094,000 | A * | 3/1992 | Becht | B23Q 11/0092 | 30/475 |
| 6,176,768 | B1 * | 1/2001 | Juang | B27C 1/04 | 144/114.1 |
| 6,249,982 | B1 * | 6/2001 | Zaiser | B27G 13/04 | 30/475 |
| 9,687,995 | B2 * | 6/2017 | Simm | B27C 1/10 | |
| 10,391,667 | B2 * | 8/2019 | Staeubli | B27C 1/10 | |
| 2007/0151114 | A1 * | 7/2007 | Papp | B27C 1/10 | 30/475 |
| 2015/0075014 | A1 * | 3/2015 | Atlagic | B27C 1/10 | 30/475 |
| 2015/0183125 | A1 * | 7/2015 | Kumakura | B27C 1/10 | 30/475 |
| 2017/0144325 | A1 * | 5/2017 | Staeubli | B27C 1/10 | |
| 2019/0329440 | A1 * | 10/2019 | Staeubli | B27C 1/10 | |

FOREIGN PATENT DOCUMENTS

| | | | | | |
|---|---|---|---|---|---|
| DE | 198 53 374 | A1 | | 5/2000 | |
| DE | 102014212158 | A1 | * | 12/2015 | B27C 1/10 |
| DE | 102014212160 | A1 | * | 12/2015 | B27C 1/10 |
| EP | 2 127 830 | A2 | | 12/2009 | |
| EP | 3160694 | B1 | * | 8/2018 | B27C 1/10 |
| EP | 3578326 | A1 | * | 12/2019 | B27C 1/10 |
| GB | 897 001 | | | 5/1962 | |
| GB | 1 437 184 | | | 5/1976 | |
| GB | 2 299 051 | A | | 9/1996 | |
| GB | 2396135 | A | * | 6/2004 | B23Q 11/0046 |
| GB | 2 449 551 | A | | 11/2008 | |
| JP | H10-6305 | A | | 1/1998 | |
| JP | 4959261 | B2 | * | 6/2012 | B27C 1/10 |
| JP | 5068905 | B2 | * | 11/2012 | B27C 1/005 |
| WO | 2009/060239 | A2 | | 5/2009 | |
| WO | WO-2015197240 | A1 | * | 12/2015 | B27C 1/10 |
| WO | WO-2015197241 | A1 | * | 12/2015 | B27C 1/10 |

* cited by examiner

PORTABLE MACHINE TOOL

This application is a 35 U.S.C. § 371 National Stage Application of PCT/EP2015/059785, filed on May 5, 2015, which claims the benefit of priority to Serial No. DE 10 2014 212 160.4, filed on Jun. 25, 2014 in Germany, the disclosures of which are incorporated herein by reference in their entirety.

BACKGROUND

Already known from DE 198 53 374 B4 is a portable power tool, in particular a hand-held power planer, which has a workpiece contact unit that has at least one workpiece contact surface, and an insert tool unit that projects partially over the workpiece contact surface in order to enable work to be performed on a workpiece.

SUMMARY

The disclosure is based on a portable power tool, in particular a hand-held power planer, having at least one workpiece contact unit that has at least one workpiece contact surface, and having at least one insert tool unit that projects at least partially over the at least one workpiece contact surface in order to enable work to be performed on a workpiece.

It is proposed that the portable power tool comprise at least one adjustment unit by means of which, in at least one state, at least one alignment of the insert tool unit and/or of the at least one workpiece contact surface relative to each other can be adjusted. Preferably, the portable power tool comprises at least one adjustment unit by means of which, in at least one state, at least one alignment, in particular a tilt and/or a planarity, of the insert tool unit relative to the at least one workpiece contact surface can be adjusted by a setting of a position of the insert tool unit and/or of a position of the at least one workpiece contact surface. Particularly preferably, the adjustment unit is likewise designed to adjust an alignment, in particular a planarity, of the at least one workpiece contact surface relative to at least one further workpiece contact surface of the workpiece contact unit by a setting of a position of the at least one workpiece contact surface. The adjustment unit is thus preferably designed, in at least one state, to adjust an alignment, in particular a planarity, of the at least one workpiece contact surface relative to the at least one further workpiece contact surface of the workpiece contact unit.

The term "workpiece contact unit" is intended here to define in particular a unit of the portable power tool that, while work is being performed on a workpiece by means of the portable power tool, the portable power tool being handled in a proper manner, is in contact with and/or lies on the workpiece, in particular by the at least one workpiece contact surface of the workpiece contact unit, and that is designed to support the portable power tool on the workpiece while work is being performed on the workpiece. Particularly preferably, the workpiece contact unit is realized as a foot plate, as a slide shoe and/or as a base plate. Preferably, while work is being performed on a workpiece, the portable power tool slides by means of the workpiece contact unit, in particular by the at least one workpiece contact surface of the workpiece contact unit, on a surface of the workpiece on which work is to be performed. In order to enable work to be performed on a workpiece, the insert tool unit projects preferably at least partially over the at least one workpiece contact surface of the workpiece contact unit of the portable power tool, as viewed along a direction substantially perpendicular to the at least one workpiece contact surface.

The expression "substantially perpendicular" is intended here to define an alignment of a direction relative to a reference direction, the direction and the relative direction, in particular as viewed in one plane, enclosing an angle of 90° and the angle having a maximum deviation of, in particular, less than 8°, advantageously less than 5°, and particularly advantageously less than 2°. "Designed" is to be understood to mean, in particular, specially configured and/or specially equipped. That an element and/or a unit are/is designed for a particular function is to be understood to mean, in particular, that the element and/or the unit fulfill/fulfills and/or execute/executes this particular function in at least one application state and/or operating state.

Particularly preferably, the adjustment unit is designed to adjust and/or compensate an alignment in the form of a tilt of the insert tool unit and/or of the at least one workpiece contact surface. The term "tilt" is intended here to define an angular offset of at least one axis and/or one surface relative to at least one further axis and/or one further surface. The adjustment unit in this case is preferably designed to adjust and/or compensate a tilt as a result of a setting of a position of the insert tool unit and/or of a position of the at least one workpiece contact surface. Preferably, the adjustment unit is designed to adjust and/or compensate a position of the insert tool unit and/or of the at least one workpiece contact surface resulting from assembly and/or housing tolerances and/or from assembly errors. The adjustment unit is preferably designed to adjust and/or compensate, as a result of a setting of a position of the insert tool unit and/or of a position of the at least one workpiece contact surface, at least a tilt about an axis of the insert tool unit and/or of the at least one workpiece contact surface that is at least substantially parallel to the at least one workpiece contact surface. Alternatively or additionally, the adjustment unit is designed, preferably, in at least one state, to adjust a planarity of the at least one workpiece contact surface relative to the at least one further workpiece contact surface of the workpiece contact unit. "Substantially parallel" is to be understood here to mean, in particular, an alignment of a direction relative to a reference direction, in particular in one plane, the direction deviating with respect to the reference direction by, in particular, less than 8°, advantageously less than 5°, and particularly advantageously less than 2°. The alignment of the insert tool unit relative to the at least one workpiece contact surface by means of the adjustment unit is preferably different from a pure positioning of the working depth of the insert tool unit or of the at least one workpiece contact surface. Particularly preferably in this case, the alignment of the insert tool unit relative to the at least one workpiece contact surface by means of the adjustment unit is different from a pure setting of planing depth by means of the insertion depth setting unit of the portable power tool.

A "portable power tool" is to be understood here to mean, in particular, a power tool, for performing work on workpieces, that can be transported by an operator without the use of a transport machine. The portable power tool has, in particular, a mass of less than 40 kg, preferably less than 10 kg, and particularly preferably less than 5 kg. Particularly preferably, the portable power tool is realized as a hand-held power planer. It is also conceivable, however, for the portable power tool to be of a different design, considered appropriate by persons skilled in the art, such as, for example, designed as a power jigsaw, as a power router, or the like. Advantageously, the portable power tool has a maximum longitudinal extent and a maximum height extent, a ratio of the maximum length extent to the maximum height extent being less than 2.5. Preferably, the ratio of the maximum longitudinal extent to the maximum height extent is less than 2.4. Particularly preferably, the maximum length extent is at least substantially parallel to the at least one workpiece contact surface, and at least substantially perpendicular to an insert tool axis, in particular a rotation axis, of the insert tool unit of the portable power tool. The maximum height extent is preferably substantially perpendicular to the at least one workpiece contact surface. Further, the portable power tool preferably has a maximum width extent, which is at least substantially parallel to the at least one workpiece contact surface, and at least substantially parallel to the insert tool axis, in particular a rotation axis, of the insert tool unit of the portable power tool. In this case, in particular, a ratio of the maximum longitudinal extent to the maximum width extent is less than 2.5, preferably less than 2.4, and particularly preferably less than 2.3. The design of the portable power tool according to the disclosure advantageously makes it possible to achieve an exact alignment of the insert tool unit relative to the at least one workpiece contact surface. Thus, advantageously, precise machining of workpieces can be achieved. Moreover, advantageously, it is possible to avoid a cost-intensive processing step in assembly of the portable power tool; in particular, it is advantageously possible to avoid milling of the at least one workpiece contact surface for the purpose or aligning the insert tool unit relative to the at least one workpiece contact surface, or a greater width of tolerance range can be applied in milling. Thus, advantageously, savings in assembly costs can be achieved. Moreover, advantageously, it is made possible for an operator to conveniently readjust an alignment of the insert tool unit relative to the at least one workpiece contact surface.

Furthermore, it is proposed that at least a parallelity between the insert tool unit, in particular an insert tool axis of the insert tool unit, and the at least one workpiece contact surface can be adjusted, in at least one state, by means of the adjustment unit. The design of the portable power tool according to the disclosure advantageously makes it possible to achieve an exactly parallel alignment of the insert tool unit relative to the at least one workpiece contact surface. Thus, particularly advantageously, workpieces can be worked in a precise manner.

It is additionally proposed that the adjustment unit have at least one setting unit, which is designed to set a position of an insert tool bearing element of the insert tool unit, for the purpose of adjusting the alignment. Preferably, a position of the insert tool bearing element, at least relative to a power tool housing of the portable power tool, can be set by means of the setting unit, for the purpose of adjusting an alignment. Thus, the setting unit is designed, in particular, to set a position of an insert tool axis of the insert tool unit for the purpose of adjusting the alignment. Preferably, the setting unit is designed to set a position of an insert tool axis of the insert tool unit along a direction that is at least substantially perpendicular to the at least one workpiece contact surface, for the purpose of adjusting the alignment. Preferably, the insert tool bearing element is realized as an axle stub.

Preferably, the axle stub is realized so as to be integral with a bearing bracket of the insert tool unit. "Integral with" is to be understood to mean, in particular, connected at least in a materially bonded manner, for example by a welding process, an adhesive process, an injection process and/or another process considered appropriate by persons skilled in the art, and/or, advantageously, formed in one piece such as, for example, by being produced from a casting and/or by being produced in a single or multi-component injection process and, advantageously, from a single blank. Preferably, a position of the bearing bracket of the insert tool unit can be set by means of the setting unit for the purpose of adjusting the alignment of the insert tool unit relative to the power tool housing. An insert tool shaft of the insert tool unit that is movably mounted on the insert tool bearing element is thus preferably movably mounted on one side. The insert tool shaft is preferably mounted so as to be movable, relative to the power tool housing, by means of the setting unit, along a direction that is at least substantially transverse to the at least one workpiece contact surface. In an alternative design, the insert tool shaft is mounted at two ends of the insert tool shaft that face away from each other, so as to be movable relative to the power tool housing. The design according to the disclosure enables an adjustment of an alignment, in particular a tilt, a parallelity and/or a planarity, of the insert tool unit relative to a workpiece contact surface to be achieved by simple design means.

It is additionally proposed that the setting unit be realized as a cam mechanism. A "cam mechanism" is to be understood here to mean, in particular, a mechanism that, as a result of a movement of a first cam mechanism element, and as a result of combined action with a second cam mechanism element, operates a component that consequently executes a movement predefined by the combined action of the cam mechanism elements. The setting unit in this case, realized as a cam mechanism, comprises at least one cam mechanism element, which is disposed on the bearing bracket. The design according to the disclosure makes it possible, advantageously, to change a position of the insert tool bearing element as a result of a movement of at least one element of the setting unit. A high degree of operating convenience can thus be achieved for an operator in aligning the insert tool unit relative to the at least one workpiece contact surface.

Furthermore, it is proposed that the setting unit have at least one eccentric element for setting the position of the insert tool bearing element. Preferably, the eccentric element engages in a cam mechanism element of the setting unit that is realized as a recess. The cam mechanism element realized as a recess is preferably disposed on the bearing bracket. The cam mechanism element in this case is realized, in particular, as an elongate hole. It is also conceivable for the cam mechanism element to be of a different design, considered appropriate by persons skilled in the art, or for the cam mechanism element to be disposed at a different position on the portable power tool, considered appropriate by persons skilled in the art. The design according to the disclosure makes it possible, advantageously, to realize an effective possibility for adjustment of the insert tool unit.

It is additionally proposed that the eccentric element have at least one actuation region, which is disposed on the eccentric element, symmetrically in relation to a movement axis of the eccentric element. The movement axis of the eccentric element is preferably realized as a rotation axis of the eccentric element. The rotation axis of the eccentric element in this case is preferably at least substantially parallel to the at least one workpiece contact surface. An "actuation region" is to be understood here to mean, in particular, a region of at least one element that, when the element is in a mounted state, can be gripped directly by an operator, or to which an actuating tool can be directly applied when the element is in a mounted state. Preferably, the actuation region is disposed on the eccentric element, so as to be rotationally symmetrical about the movement axis of the eccentric element. Preferably, the actuation region is disposed on the eccentric element in the form of a circle around the movement axis on the eccentric element. It is also conceivable, however, for the actuation region to be portionally disposed around the movement axis on the eccentric element, for example as a result of the actuation region being disposed in a star shape around the movement axis, or as a result of the actuation region being designed in the manner of a lever. Further designs of the actuation region, considered appropriate by persons skilled in the art, are likewise conceivable. The design according to the disclosure makes it possible, advantageously, to achieve a high degree of operating convenience with regard to operability of the eccentric element. Moreover, it is advantageously possible to achieve a compact design of the setting unit, since it is advantageously possible, at least substantially, to dispense with additional components for actuating the setting unit.

It is additionally proposed that the eccentric element have at least one fixing element receiving region, which is designed to receive a fixing element of the adjustment unit that is designed to fix the eccentric element in at least one position. Preferably, the fixing element receiving region is disposed on the eccentric element, symmetrically in relation to a movement axis of the eccentric element. The fixing element is preferably realized as a screw. It is also conceivable, however, for the fixing element to be of a different design, considered appropriate by persons skilled in the art, such as, for example, designed as rivets, pins or the like. The design according to the disclosure makes it possible, advantageously, to achieve a compact arrangement of the fixing element on the eccentric element. Moreover, advantageously, a projection of the fixing element over the eccentric element along at least one direction can be kept small. As a result, advantageously, a risk of injury to an operator can be kept small.

Furthermore, it is proposed that the at least one workpiece contact surface be mounted in a movable manner, and the adjustment unit have at least one guide unit, which is designed to limit to one a number of degrees of freedom of movement of the at least one movably mounted workpiece contact surface of the workpiece contact unit. Preferably, the at least one workpiece contact surface is mounted in a translationally movable manner. The at least one workpiece contact surface in this case is preferably movably mounted on the power tool housing, in a translationally movable manner, for the purpose of setting a planing depth. The guide element is preferably designed to limit to one a number of degrees of freedom of movement of the at least one movably mounted workpiece contact surface of the workpiece contact unit along a movement direction of the at least one workpiece contact surface that is at least substantially transverse to the at least one workpiece contact surface.

"Substantially transverse" is to be understood here to mean, in particular, an alignment of a direction and/or an axis relative to a reference surface and/or a reference axis, the alignment of the direction and/or of the axis differing at least from an at least substantially parallel alignment in relation to the reference surface and/or to the reference axis and, in particular, being skew or perpendicular to the reference surface and/or reference axis. The design according to the disclosure makes it possible, advantageously, to achieve precise guiding of the at least one workpiece contact surface for the purpose of aligning the insert tool unit relative to the at least one workpiece contact surface. Moreover, maintenance of a set alignment of the insert tool unit relative to the at least one workpiece contact surface can be achieved by advantageously simple design means.

Further, it is proposed that the guide unit comprise at least one anti-rotation element, which is designed to secure at least the at least one movably mounted workpiece contact surface of the workpiece contact unit against rotation about at least one movement axis of the workpiece contact unit. For this purpose, the anti-rotation element preferably extends at least substantially transversely in relation to the movement axis of the at least one workpiece contact surface. Preferably, the anti-rotation element is realized as an extension, in particular a rib-shaped extension. It is also conceivable, however, for the anti-rotation element to be of a different design, considered appropriate by persons skilled in the art. The design according to the disclosure makes it possible, advantageously, to achieve maintenance of an alignment of the at least one workpiece contact surface relative to the insert tool unit during a movement of the at least one workpiece contact surface, in particular during setting of a planing depth.

It is additionally proposed that the portable power tool comprise at least one insertion depth setting unit, which comprises at least one insertion depth setting element, wherein the adjustment unit has at least one play avoidance element that is designed to avoid, at least substantially, a movement play of the insertion depth setting element. It is thus possible, advantageously, to avoid play, and thus to avoid a change in an alignment during a movement of the at least one workpiece contact surface.

Furthermore, it is proposed that the play avoidance element be designed to apply at least a clamping force to the insertion depth setting element, along a that is at least substantially transverse to a movement axis of the insertion depth setting element. Preferably, the insertion depth setting element is realized as a threaded bolt, which is pressed into thread leads of a thread of the insertion depth setting unit, for the purpose of reducing play or avoiding play by means of the play avoidance element. Preferably, the thread of the insertion depth setting unit is disposed on the at least one workpiece contact surface, in particular realized so as to be integral with the at least one workpiece contact surface. A play of the insertion depth setting element can thus be avoided or reduced by simple design means.

It is additionally proposed that the play avoidance element be realized so as to be elastic. "Elastic" is to be understood to mean, in particular, a property of an element, the element being repeatedly deformable without the element being thereby mechanically damaged or destroyed and, in particular, automatically seeking to return to a basic shape following a deformation. The play avoidance element in this case may be realized as an elastomer element, as a rubber element, as a spring element or the like. The design according to the disclosure, by simple design means, enables a movement play of the insertion depth setting element to be kept small.

Advantageously, the adjustment unit comprises at least one surface position adjustment unit, for the purpose of adjusting the at least one movably mounted workpiece contact surface, comprises at least one insertion depth operating element and at least one rotary disk element, which are mounted so as to be movable relative to each other, in at least one state. Preferably, the insertion depth operating element can be fixed to the rotary disk element in a rotationally fixed manner by means of a fastening element, in particular by means of at least one screw, in at least one state. The insertion depth operating element is thus preferably mounted so as to be movable relative to the rotary disk element when the fastening element is in a released state. The design according to the disclosure makes it possible, by simple design means, to achieve a possibility for adjusting the at least one movably mounted workpiece contact surface. Advantageously, it is possible to achieve a rotary position of the insertion depth operating element, relative to the rotary disk element, that can be used to adjust an alignment of the at least one movably mounted workpiece contact surface. In this case, advantageously, it is possible to realize a translational movement of the movably mounted workpiece contact surface as a result of a rotary movement of the rotary disk element relative to the insertion depth operating element, wherein, particularly advantageously, a zero position of the insertion depth setting unit of the portable power tool can be adjusted relative to the rotary disk element by means of a movement of the insertion depth operating element, after a translational movement of the at least one movably mounted workpiece contact surface has been effected.

It is additionally proposed that the portable power tool comprise at least one insert tool contact protection unit, which has at least one contact protection element, which is disposed on the adjustment unit. The contact protection element is preferably designed to avoid, at least largely, in particular completely, contacting of a cutting element of the insert tool unit by an operator while work is being performed on a workpiece. For this purpose, the contact protection element, when disposed on the adjustment unit, extends at least substantially transversely in relation to the insert tool axis and/or at least substantially transversely in relation to the at least one workpiece contact surface. The design according to the disclosure advantageously makes it possible to realize an additional function of the adjustment unit. Moreover, advantageously, a high degree of operator safety can be achieved.

Furthermore, it is proposed that the contact protection element be movably mounted on the adjustment unit. Preferably, a movement axis of the contact protection element is preferably at least substantially parallel to the insert tool axis of the insert tool unit. Preferably, the contact protection element is pivotally mounted on the adjustment unit. The contact protection element in this case can be fixed in at least one position by means of a fastening element of the adjustment unit, in particular by means of at least one fastening element that is designed to fix the bearing bracket to the housing of the power tool. The design according to the disclosure advantageously makes it possible to achieve a high degree of operating convenience and an advantageous adjustment of a position of the contact protection element. Thus, advantageously, a position can be adjusted to a set planing depth.

Additionally proposed is a method for adjusting an alignment of the insert tool unit relative to the at least one workpiece contact surface of the workpiece contact unit of the portable power tool according to the disclosure. Preferably, in at least one method step, the portable power tool is disposed in a device that has at least one measuring unit for measuring an alignment, in particular a parallelity, of the insert tool unit relative to the at least one workpiece contact surface. Alternatively, however, it is also conceivable that only the measuring unit can be disposed on the portable power tool, in particular on the workpiece contact unit. Preferably, in a further method step, the adjustment unit is actuated. In this case, preferably, the eccentric element is moved. Thus, preferably, a position of the bearing bracket element relative to the power tool housing is changed. Following display of a parallel alignment of the insert tool unit relative to the at least one workpiece contact surface, by means of the at least one display unit of the measuring unit, the bearing bracket is fixed relative to the power tool housing. An alignment of the at least one workpiece contact surface can thus be checked by means of the measuring unit. After an alignment has been effected as a result of an actuation of the adjustment unit, in particular the surface position adjustment unit, the at least one workpiece contact surface is fixed in an adjusted alignment. It is thus advantageously possible to achieve user-friendly adjustment of an alignment of the insert tool unit relative to the at least one workpiece contact surface.

Additionally proposed is a method for adjusting an alignment of the at least one workpiece contact surface of the workpiece contact unit of a portable power tool according to the disclosure. In at least one method step, the workpiece contact unit can be disposed on the power tool housing. The at least one workpiece contact unit is movably mounted and guided on the power tool housing by means of the guide unit of the adjustment unit. After the at least one workpiece contact surface has been disposed on the power tool housing, the at least one workpiece contact surface can be connected to the insertion depth setting unit. In this case, the at least one workpiece contact surface can be aligned substantially parallel to at least one further workpiece contact surface of the workpiece contact unit, in particular with the aid of a measuring unit, by means of a movement of the rotary disk element. Following an alignment of the at least one workpiece contact surface relative to the at least one further workpiece contact surface, an insertion depth operating element is in a "zero position", in which the workpiece contact surface and the at least one further workpiece contact surface are disposed in a common plane, being able to be fixed to the rotary disk element in a rotationally fixed manner. For the purpose of a new alignment of the at least one workpiece contact surface relative to the at least one further workpiece contact surface, for example because of wear, the rotationally fixed connection between the insertion depth operating element and the rotary disk element can be undone, in order to adjust the "zero position" again. Thus, advantageously, a reliable adjustment of the at least one workpiece contact surface can be achieved.

As used herein, the term "unit" refers to a group of elements that are regarded as an entity because they cooperate to perform a particular function. The elements of the unit need not be structurally contiguous.

The portable power tool according to the disclosure is not intended to be limited to the application and embodiment described above. In particular, the portable power tool according to the disclosure may have individual elements, components and units that differ in number from a number stated herein, in order to fulfill a principle of function described herein. Moreover, in the case of the value ranges specified in this disclosure, values lying within the stated limits are also to be deemed as disclosed and applicable in any manner.

BRIEF DESCRIPTION OF THE DRAWINGS

Further advantages are disclosed by the following description of the drawings. The drawings show an exemplary embodiment of the disclosure. The drawings, the description and the claims contain numerous features in combination. Persons skilled in the art will also expediently consider the features individually and combine them to create appropriate further combinations.

There are shown in.

DETAILED DESCRIPTION

Figure 1:
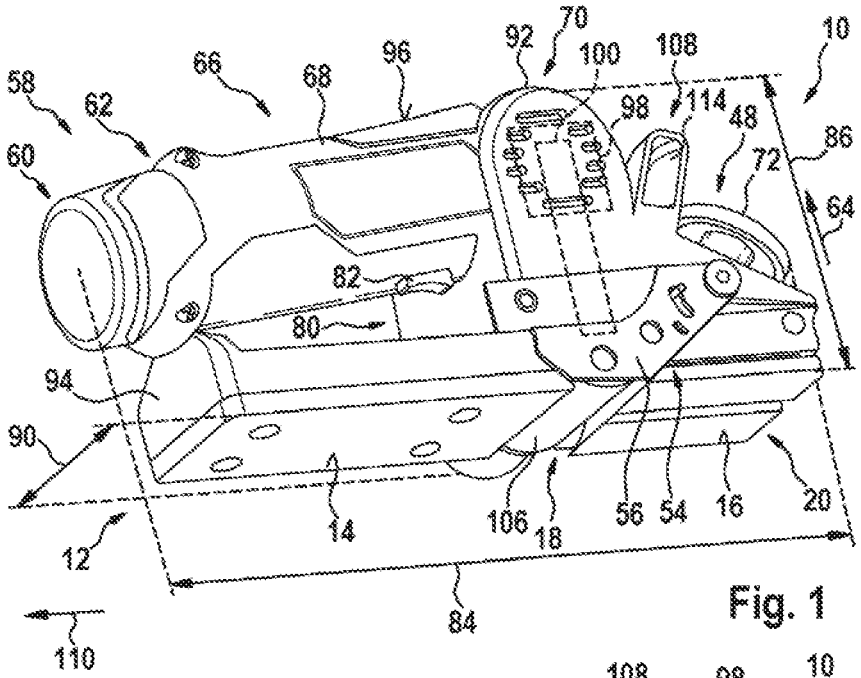
FIG. 1 a portable power tool according to the disclosure, in a schematic representation, FIG. 2 a sectional view of a guide unit of an adjustment unit of the portable power tool, for adjusting an alignment of at least one movably mounted workpiece contact surface of a workpiece contact unit of the portable power tool according to the disclosure, in a schematic representation, FIG. 3 a detail view of a setting unit of the adjustment unit, for adjusting an alignment of an insert tool unit of the portable power tool according to the disclosure, in a schematic representation, FIG. 4 a detail view of the setting unit, in a schematic representation, FIG. 5 a detail view of an insert tool bearing element of the setting unit, in a schematic representation, FIG. 6 a further detail view of the insert tool bearing element, in a schematic representation, FIG. 7 a detail view of an eccentric element of the setting unit, in a schematic representation, and FIG. 8 a further detail view of the eccentric element, in a schematic representation.

FIG. 1 shows a power tool system 58, having at least one portable power tool 10 and having at least one energy storage unit 60. The power tool system 58 has a maximum total mass that is less than 1.5 kg. The portable power tool 10 in this case has a maximum total individual mass that is less than 1 kg. The energy storage unit 60 has a maximum total individual mass that is less than 0.5 kg. The energy storage unit 60 in this case is realized as a storage battery unit. In addition, the energy storage unit 60 is disposed in a removable manner on the portable power tool 10. For this purpose, the portable power tool 10 comprises at least one energy storage receiving unit. 62, by means of which the energy storage unit 60 can be disposed and/or fixed on the portable power tool 10, in a manner already known to persons skilled in the art. The energy storage unit 60, when having been disposed on the portable power tool 10, is disposed, at least substantially, entirely above a center of gravity axis of the portable power tool 10, as viewed along a direction 64 that is at least substantially, in particular entirely, perpendicular to at least one workpiece contact surface 14 of a workpiece contact unit 12 of the portable power tool. The portable power tool 10 in this case is realized as a battery-operated, portable power tool. It is also conceivable, however, for the portable power tool 10 to be realized, in alternative design not represented in greater detail here, as a portable power tool operated via a power cord.

The portable power tool 10 is realized as a hand-held power planer. The portable power tool 10 thus comprises at least the workpiece contact unit 12, which has at least the workpiece contact surface 14, and at least one handle unit 66, which has at least one main handle 68. The workpiece contact unit 12 comprises in total at least two workpiece contact surfaces 14, 16. The workpiece contact surfaces 14, 16, in particular at least in an adjusted state, are at least substantially, in particular entirely, parallel to each other. It is also conceivable, however, for the workpiece contact unit 12 to have a number of workpiece contact surfaces 14, 16 other than two. One of the workpiece contact surfaces 14, 16 in this case is movably mounted on a power tool housing 70 of the portable power tool 10. The other of the workpiece contact surfaces 14, 16 is disposed in a fixed manner on the power tool housing 70. In this case, the workpiece contact surface 14 disposed in a fixed manner on the power tool housing 70 is constituted by a base plate element of the workpiece contact unit 12. The workpiece contact surface 16 that is movably mounted on the power tool housing 70 is constituted by a further base plate element of the workpiece contact unit 12. A position of the workpiece contact surface 16 that is movably mounted on the power tool housing 70 can be set relative to the power tool housing 70 by means of an insertion depth setting unit 48 of the portable power tool 10, in a manner already known to persons skilled in the art. The insertion depth setting unit 48 is thus designed, in a manner already known to persons skilled in the art, to set an insertion depth, in particular a planing depth, of an insert tool unit 18 of the portable power tool 10. For the purpose of setting an insertion depth, the insertion depth setting unit 48 comprises at least one insertion depth operating element 72. The insertion depth operating element 72 is rotatably mounted on the power tool housing 70. The insertion depth operating element 72 additionally constitutes a further support surface for a hand of an operator, for the purpose of guiding the portable power tool 10, in a manner already known to persons skilled in the art. The insert tool unit 18 of the portable power tool 10 projects at least partially over the at least one workpiece contact surface 14, 16, to enable work to be performed on a workpiece.

The portable power tool 10 additionally comprises at least one operating unit 80, which is designed to open and/or close an electric circuit as a result of being actuated by an operator. The operating unit 80 has at least one operating element 82. The operating element 82 is disposed on the main handle 68. The operating element 82 in this case is movably mounted on the main handle 68. The operating element 82 is mounted in a translationally movable manner on the main handle 68. It is also conceivable for the operating element 82 to be pivotally mounted on the main handle 68. The operating element 82 is designed, in a manner already known to persons skilled in the art, to actuate an electric switch element (not represented in greater detail here) of the portable power tool 10.

Further, the portable power tool 10 has a maximum longitudinal extent 84 and a maximum height extent 86, a ratio of the maximum longitudinal extent 84 to the maximum height extent 86 being less than 2.5. The maximum longitudinal extent 84 is at least substantially, in particular entirely, parallel to at least one of the workpiece contact surfaces 14, 16, and at least substantially, in particular entirely, perpendicular to an insert tool axis 88 of the insert tool unit 18 of the portable power tool 10. The maximum height extent 86 is at least substantially, in particular entirely, perpendicular to at least one of the workpiece contact surfaces 14, 16. The portable power tool 10 additionally has a maximum width extent 90, which is at least substantially, in particular entirely, parallel to at least one of the workpiece contact surfaces 14, 16, and at least substantially, in particular entirely, parallel to the insert tool axis 88 of the insert tool unit 18. In this case, a ratio of the maximum longitudinal extent 84 to the maximum width extent 90 is less than 2.5.

The power tool housing 70 additionally comprises at least two housing shell elements 92, 94, which are connected to each other. The housing shell elements 92, 94 in this case are fixed to each other by means of fastening elements, in particular screws. The power tool housing 70 is thus of a half-shell design. It is also conceivable, however, for the power tool housing 70 to be of a different design, considered appropriate by persons skilled in the art, such as, for example, a cup-type design, or a combination of a cup-type and a shell-type design, or the like. The power tool housing 70 is made of a plastic. In particular, all components of the portable power tool 10 are disposed directly in the housing shell elements 92, 94. Thus, all bearing seats or receivers for the components of the portable power tool 10 are constituted by the housing shell elements 92, 94. In particular, apart from bearing elements such as, for example, rolling bearings or slide bearings, it is advantageously possible to dispense with additional metallic elements for seating and/or receiving the individual components.

The housing bearing elements 92, 94, when having been fixed to each other, constitute a main handle 68. Each of the housing shell elements 92, 94 preferably constitutes one half of the main handle 68. In this case, the energy storage receiving unit 62 is disposed mostly in the main handle 68. Preferably, the energy storage receiving unit 62 is disposed entirely in the main handle 68. The energy storage receiving unit 62 has at least one energy storage guide element (not represented in greater detail here), which has a main extent that is at least substantially, in particular entirely, parallel to the workpiece contact surfaces 14, 16. The energy storage guide element in this case is disposed on a side of one of the housing shell elements 92, 94 that faces away from a gripping surface 96 of the main handle 68, and that is constituted by an inner wall of one of the housing shell elements 92, 94. The energy storage guide element is of a rib-type design. It is also conceivable, however, for the energy storage guide unit to be of a different design, considered appropriate by persons skilled in the art, such as, for example, a groove type design or the like. The energy storage receiving unit 62 has in total at least two energy storage guide elements. It is also conceivable, however, for the energy storage receiving unit 62 to have a number of energy storage guide elements other than two. The energy storage guide elements are of an at least substantially similar design. In this case, each one of the energy storage guide elements is disposed, respectively, on an inner wall of one of the housing shell elements 92, 94. Thus, when the housing shell elements 92, 94 have been fixed to each other, the energy storage guide elements are disposed on two inner sides of the power tool housing 70 that face toward each other. The energy storage guide elements are at least substantially, in particular entirely, parallel to each other. The energy storage receiving unit 62 in this case is disposed on a side of the power tool housing 70 that faces away from the workpiece contact unit 12. The main handle 68 is thus likewise disposed on a side of the power tool housing 70 that faces away from the workpiece contact unit 12.

The main handle 68 has at least one maximum distance point that, as viewed along the direction 64 that is at least substantially, in particular entirely, perpendicular to at least one of the workpiece contact surfaces 14, 16, has a maximum distance of less than 150 mm in relation to at least one of the workpiece contact surfaces 14, 16. The maximum distance point in this case is disposed on a side of the gripping surface of the main handle 68 that faces away from the workpiece contact unit 12. Preferably, the maximum distance point has, in particular, as viewed along the direction 64 that is at least substantially perpendicular to at least one of the workpiece contact surfaces 14, 16, a maximum distance of less than 120 mm in relation to at least one of the workpiece contact surfaces 14, 16. In particular, when the movably mounted workpiece contact surface 16 is in a fully retracted state, in which the movably mounted workpiece contact surface 16 is in contact with a stop of the power tool housing 70, the maximum distance point has a maximum distance of less than 120 mm relative to the movably mounted workpiece contact surface 16.

Furthermore, the portable power tool 10 has at least the center of gravity axis, which is at least substantially, in particular entirely, parallel to at least one of the workpiece contact surfaces 14, 16, and which, as viewed along the direction 64 that is at least substantially perpendicular to at least one of the workpiece contact surfaces 14, 16, has a maximum distance of less than 90 mm in relation to the maximum distance point. The center of gravity axis in this case has a maximum distance of less than 60 mm, in particular less than 50 mm, in relation to at least one of the workpiece contact surfaces 14, 16. Moreover, the center of gravity axis is at least substantially, in particular entirely, parallel to at least one of the workpiece contact surfaces 14, 16.

Figure 3:
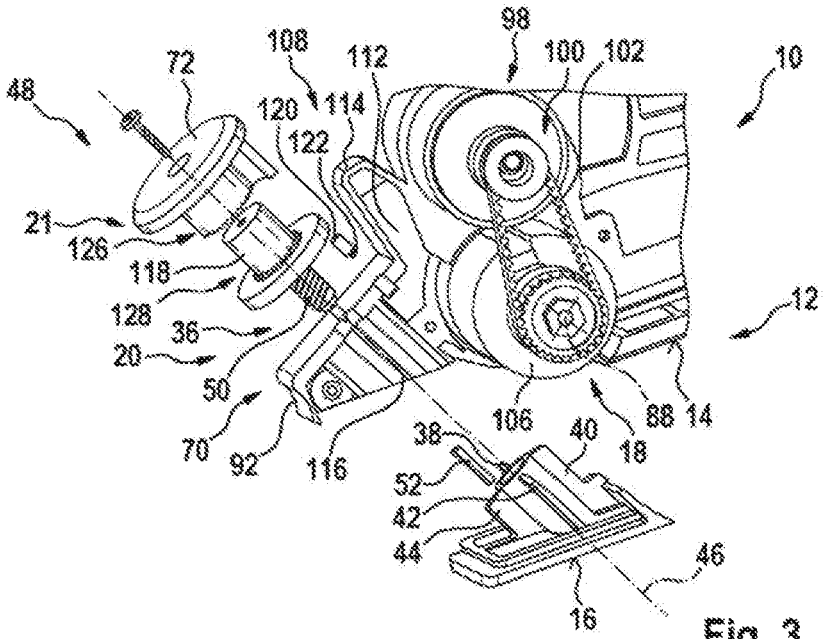

Furthermore, the portable power tool 10 has at least one drive unit 98 that, as viewed along the direction 64 that is at least substantially perpendicular to at least one of the workpiece contact surfaces 14, 16, is at least mostly disposed above the center of gravity axis (FIG. 3). In this case, at least 60% of a total volume of the drive unit 98 is disposed above the center of gravity axis. In a particularly preferred design of the portable power tool 10, the drive unit 98 is disposed entirely above the center of gravity axis. The drive unit 98 is realized as an EC motor unit. It is also conceivable, however, for the drive unit 98 to be of a different design, considered appropriate by persons skilled in the art, in particular, in the case of an alternative design of the portable power tool 10, as a portable power tool operated via a power cord. The drive unit 98 has at least one drive axis that, as viewed along the direction. 64 that is at least substantially perpendicular to at least one of the workpiece contact surfaces 14, 16, has a minimum distance of greater than 45 mm in relation to at least one of the workpiece contact surfaces 14, 16. The drive axis in this case is at least substantially, in particular entirely, parallel to at least one of the workpiece contact surfaces 14, 16. In addition, the drive axis intersects an axis of main extent of the main handle 68. The axis of main extent of the main handle 68 is substantially, in particular entirely, parallel to at least one of the workpiece contact surfaces 14, 16. It is also conceivable, however, for the drive axis to have a parallel offset, of less than 10 mm, or to be skew in relation to the axis of main extent of the main handle 68.

The drive unit 98 is designed to drive the insert tool unit 18 of the portable power tool 10. The portable power tool 10 in this case has at least one output unit 100 (FIG. 3), by means of which the drive unit 98 is operatively connected to the insert tool unit 18, in a manner already known to persons skilled in the art. The output unit 100 comprises at least one driving-force transmission element 102 for transmitting driving forces and/or driving torques from the drive unit 98 to the insert tool unit 18 (FIG. 3). The driving-force transmission element 102 is realized as a drive belt, in particular as a toothed belt. It is also conceivable, however, for the driving-force transmission element 102 to be of a different design, considered appropriate by persons skilled in the art, such as, for example, designed as a toothed wheel or the like. The insert tool unit 18 is realized as a planer blade unit. The insert tool unit 18 in this case has at least one cutting element 104 (FIGS. 2 and 3) for removing workpiece particles of a workpiece on which work is to be performed (not represented in greater detail here). It is also conceivable, however, for the insert tool unit 18 to have more than one cutting element 104. The cutting element 104 is realized as a planer blade. In addition, the cutting element 104 is disposed on a rotational element 106 of the insert tool unit 18, in a manner known to persons skilled in the art. The rotational element 106 is realized as a planer shaft. The rotational element 106 is thus rotatably mounted in the power tool housing 70, in particular in the two housing shell elements 92, 94. The insert tool axis 88 of the insert tool unit 18, in particular of the rotational element 106, is at least substantially, in particular entirely, parallel to at least one of the workpiece contact surfaces 14, 16. In addition, the insert tool axis 88 of the insert tool unit 18 is at least substantially, in particular entirely, parallel to the drive axis of the drive unit 98.

Furthermore, the portable power tool 10 has at least one insert tool unit 18, the drive unit 98, as viewed along the direction 64 that is at least substantially perpendicular to at least one of the workpiece contact surfaces 14 16, being mostly disposed above the insert tool unit 18 (FIG. 3). The drive unit 98 in this case is disposed entirely above the insert tool unit 18. The insert tool unit 18 and the drive unit 98 in this case, as viewed along the direction 64 that is at least substantially perpendicular to at least one of the workpiece contact surfaces 14 16, have a minimum distance of greater than 1 mm, in particular greater than 10 mm, in relation to each other.

Further, the portable power tool 10 comprises at least one workpiece debris discharge unit 108, which is disposed in front of the insert tool unit 18 as viewed along a direction. 110 that is at least substantially, in particular entirely, parallel to at least one of the workpiece contact surfaces 14, 16. The workpiece debris discharge unit 108 is disposed in front of the insert tool unit 18 as viewed along a direction that is contrary to a working direction of the portable power tool 10 and along which the portable power tool 10 can be moved for the purpose of performing work on a workpiece. The workpiece debris discharge unit 108 in this case is designed to convey, out of an insert tool rotation region of the power tool housing 70 and out of the power tool housing 70 itself, following removal, workpiece particles that have been removed by means of the insert tool unit 18. Workpiece particles are conveyed by the workpiece debris discharge unit 108 by means of a rotational energy of the insert tool unit 18.

Figure 2:
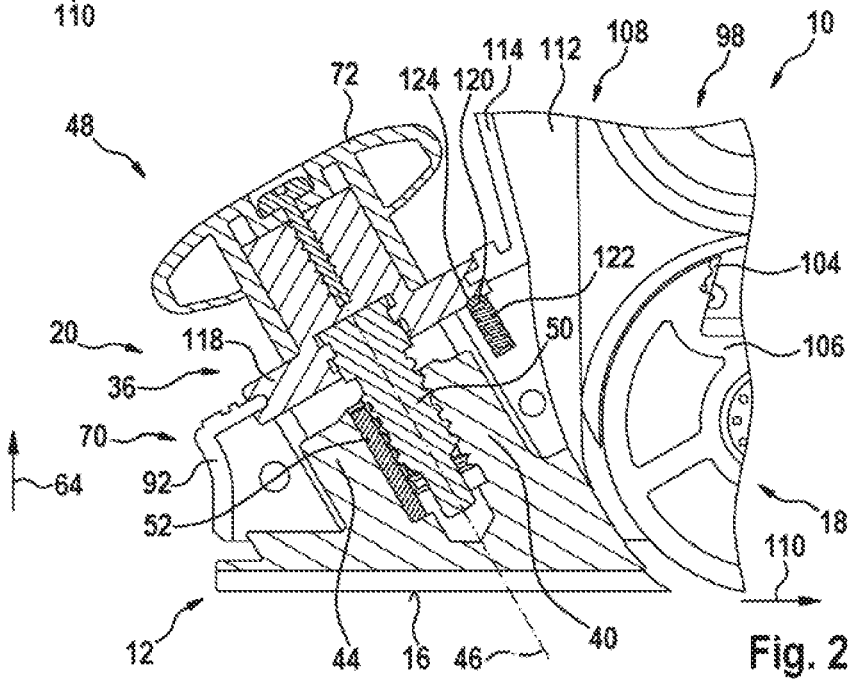

For the purpose of outputting workpiece particles from the power tool housing 70, the workpiece debris discharge unit 108 comprises at least one discharge channel 112, which connects a side of the power tool housing 70 that faces away from the workpiece contact unit 12 to the insert tool rotation region (FIGS. 2 and 3). The discharge channel 112 in this case is designed to deflect workpiece particles, which are removed from a workpiece by means of the insert tool unit 18, in such a manner that the workpiece particles can be conveyed out of the power tool housing 70. Starting from the insert tool rotation region, the discharge channel 112 in this case extends at least substantially transversely in relation to at least one of the workpiece contact surfaces 14, 16. The workpiece debris discharge unit 108 may also comprise more than one discharge channel 112 for conveying removed workpiece particles out of the power tool housing 70. The workpiece debris discharge unit 108 may also comprise a flap unit, by means of which an operator can deflect removed workpiece particles into the differing discharge channels 112 of the workpiece debris discharge unit 108. By means of the flap unit, it is thus possible to set, for example, the side of the power tool housing 70 on which removed workpiece particles can be conveyed out of the power tool housing 70 by means of the workpiece debris discharge unit 108. The workpiece debris discharge unit 108 additionally has at least one suction extraction connecting element 114, which can be connected to an external suction extraction unit (not represented in greater detail here). The suction extraction connecting element 114 is directly connected to the discharge channel 112. The suction extraction connecting element 114 in this case may be realized so as to be integral with the power tool housing 70, or realized separately from the power tool housing 70, the suction extraction connecting element 114 being detachably connectable to the discharge channel 112. The suction extraction connecting element 114, in particular when having been connected to the discharge channel 112, extends at least substantially transversely in relation to at least one of the workpiece contact surfaces 14, 16. It is additionally conceivable for the suction extraction connecting element 114 to be movably mounted on the power tool housing 70.

Furthermore, the portable power tool 10 comprises at least one adjustment unit 20, by means of which, in at least one state, at least one alignment of the insert tool unit 18 and/or of at least one of the workpiece contact surfaces 14, 16 relative to each other can be adjusted. By means of the adjustment unit 20, at least one alignment of the insert tool unit 18 relative to at least one of the workpiece contact surfaces 14, 16 can be adjusted, in at least one state, by a setting of a position of the insert tool unit. 18 and/or of a position of at least one of the workpiece contact surfaces 14, 16. The adjustment unit 20 is designed to adjust and/or compensate a relative alignment, realized as a tilt, parallelity and/or planarity, between the insert tool unit 18 and at least one of the workpiece contact surfaces 14, 16 by a setting of a position of the insert tool unit 18 and/or of a position of at least one of the workpiece contact surfaces 14, 16. The tilt that can be adjusted by means of the adjustment unit 20 is in this case a tilt of the insert tool unit 18 and/or at least one of the workpiece contact surfaces 14, 16 about a tilt axis that is at least substantially, in particular entirely, parallel to at least one of the workpiece contact surfaces 14, 16. The tilt axis in this additionally extends along a direction that is at least substantially, in particular entirely, perpendicular to the drive axis of the drive unit 98 or to the insert tool axis 88 of the rotational element 106. Thus, at least a parallelity, between the insert tool unit 18 and at least one of the workpiece contact surfaces 16, 16, can be adjusted, in at least one state, by means of the adjustment unit 20. Further, the adjustment unit 20 is designed to adjust a planarity of the workpiece contact surfaces 14, 16 relative to each other, in at least one state.

The adjustment unit 20 has at least one guide unit 36, also referred to herein as a guide arrangement, which is designed to limit to one a number of degrees of freedom of movement of the at least one movably mounted workpiece contact surface 16 of the workpiece contact unit 12. For this purpose, the guide unit 36 comprises at least one anti-rotation element 38 (FIG. 3), which is designed to secure the at least one movably mounted workpiece contact surface 16 of the workpiece contact unit 12 against rotation about at least one movement axis 46 of the workpiece contact unit 12. The guide unit 36 has in total four anti-rotation elements 38, 40, 42, 44, which are designed to secure the at least one movably mounted workpiece contact surface 16 of the workpiece contact unit 12 against rotation about at least the movement axis 46 of the workpiece contact unit 12. It is also conceivable, however, for the guide unit 36 to have a number of anti-rotation elements 38, 40, 42, 44 other than four. The anti-rotation elements 38, 40, 42, 44 in this case are realized so as to be integral with the movably mounted workpiece contact surface 16. The anti-rotation elements 38, 40, 42, 44 in this case, as viewed along a direction about the movement axis 46 of the workpiece contact unit 12, are disposed with an even distribution on the movably mounted workpiece contact surface 16, in particular on an insertion-depth setting-element receiving region of the movably mounted workpiece contact surface 16. The anti-rotation elements 38, 40, 42, 44 in this case are disposed in the form of a cross on the insertion-depth setting-element receiving region of the movably mounted workpiece contact surface 16. In addition, for the purpose of guiding movement and limiting degrees of freedom of movement of the movably mounted workpiece contact surface 16, the anti-rotation elements 38, 40, 42, 44 engage in guide recesses 116 in the guide unit 36 (only one of the guide recesses 116 is represented in FIG. 3). The guide recesses 116 are realized so as to be integral with the housing shell elements 92, 94. In this case, respectively one of the guide recesses 116 is disposed entirely on one of the housing shell elements 92, 94. Two of the guide recesses 116 are in each case half-wise disposed on one of the housing shell elements 92, 94. As a result of the housing shell elements 92, 94 being fixed to each other, the guide recesses 116 that are half-wise disposed on the housing shell elements 92, 94 are designed to constitute guide grooves, in which there engages, respectively, one of two of the anti-rotation elements 38, 40, 42, 44.

Disposed on the insertion-depth setting-element receiving region of the movably mounted workpiece contact surface 16 there is at least one thread, in particular an internal thread, of the insertion depth setting unit 48 and of the adjustment unit 20. The insertion depth setting unit 48 comprises at least one insertion depth setting element 50 (FIG. 3), which engages in the thread of the insertion depth setting unit 48 and of the adjustment unit 20 that is disposed on the insertion-depth setting-element receiving region. The insertion depth setting element 50 is thus realized as a threaded bolt. The adjustment unit 20 has at least one play avoidance element 52, which is designed to avoid, at least substantially, a movement play of the insertion depth setting element 50. The play avoidance element 52 in this case is designed to apply at least one clamping force to the insertion depth setting element 50, along a that is at least substantially transverse to a movement axis of the insertion depth setting element 50. For this purpose, the play avoidance element 52 is disposed on the thread of the insertion depth setting unit 48 and of the adjustment unit 20 that is disposed on the insertion-depth setting-element receiving region. The play avoidance element 52 is realized so as to be elastic. Thus, by means of the play avoidance element 52, for the purpose of avoiding a play of the insertion depth setting element 50, the insertion depth setting element 50 can be pressed into thread leads of the thread of the insertion depth setting unit 48 and of the adjustment unit 20 that is disposed on the insertion-depth setting-element receiving region.

The insertion depth setting element 50 is fixed to a rotary disk element 118 of the insertion depth setting unit 48 in a rotationally fixed manner. In this case, the insertion depth setting element 50 is fixed to the rotary disk element 118 in a rotationally fixed manner by means of an injection method. It is also conceivable, however, for the insertion depth setting element 50 to be fixed to the rotary disk element 118 in a rotationally fixed manner by means of a different method, considered appropriate by persons skilled in the art, such as, for example, by means of an adhesive method, by means of a screw connection method, by means of a riveting method or the like. The rotary disk element 118 is rotatably mounted on the power tool housing 70, in particular mounted with little play on the power tool housing 70. The rotary disk element 118 in this case is rotatably mounted in the housing shell elements 92, 94. A rotation axis of the rotary disk element 118 extends, in particular, in a connecting plane of the housing shell elements 92, 94. The rotary disk element 118 is designed to accommodate the insertion depth operating element 72. The insertion depth operating element 72 can be fixed to the rotary disk element 118 in a rotationally fixed manner by means of at least one fastening element of the insertion depth setting unit 48, in particular by means of at least one screw. The rotary disk element 118 can thus likewise be rotated as a result of a rotary movement of the insertion depth operating element 72, for the purpose of setting a planing depth. For the purpose of setting a rotary position of the rotary disk element 118 relative to the power tool housing 70, the insertion depth setting unit 48 comprises at least one rotary position fixing element 120 (FIGS. 2 and 3). The rotary position fixing element 120 is mounted in a translationally movable manner in the power tool housing 70. In addition, a spring force can be applied to the rotary position fixing element 120, in the direction of the rotary disk element 118, by means of a spring element 122 of the insertion depth setting unit 48. The spring element 122 is realized as a compression spring. It is also conceivable, however, for the spring element 122 to be of a different design, considered appropriate by persons skilled in the art. For the purpose of fixing a rotary position of the rotary disk element 118, the rotary position fixing element 120 engages in at least one latching recess 124 of the rotary disk element 118. The rotary disk element 118 has in total a multiplicity of latching recesses 124, which are disposed with an even distribution on the rotary disk element 118, as viewed along a direction about the rotation axis of the rotary disk element 118.

For the purpose of adjusting a parallelity and/or a planarity of the workpiece contact surfaces 14, 16 relative to each other by means of the adjustment unit 20, the insertion depth operating element 72 can be rotated relative to the rotary disk element 118, in at least one state, in particular in a state in which the insertion depth operating element 72 is not fixed to the rotary disk element 118. This renders possible "zeroizing" of the insertion depth setting unit 48, in order to adjust a parallelity and/or a planarity of the workpiece contact surfaces 14, 16 relative to each other by means of the adjustment unit 20. When the insertion depth operating element 72 is in a state in which it is not fixed to the rotary disk element 118, a position of the workpiece contact surfaces 14, 16 relative to each other can be set as a result of a rotation of the rotary disk element 118 relative to the insertion depth operating element 72. As soon as a parallelity and/or a planarity of the workpiece contact surfaces 14, 16 relative to each other has been set, the insertion depth operating element 72 can again be fixed to the rotary disk element 118 in a rotationally fixed manner, and it is possible to align the insertion depth operating element 72 to a zero point of a scale disposed on the rotary disk element 118. On the side that faces toward the rotary disk element 118, the insertion depth operating element 72 has a latching receiving region 126, which is designed for pre-positioning the insertion depth operating element 72 relative to the rotary disk element. 118 (FIG. 3). The latching receiving region 126 of the insertion depth operating element 72 in this case has a multiplicity of latching recesses that, as viewed along a direction about the rotation axis of the insertion depth operating element 72, are disposed with an even distribution on the insertion depth operating element 72. For example, the latching receiving region 126 of the insertion depth operating element 72 comprises between 10 and 30 latching recesses, which are disposed with an even distribution on the insertion depth operating element 72. It is also conceivable, however, for the latching recesses of the latching receiving region 126 of the insertion depth operating element. 72 to be disposed unevenly, or evenly along an angular range of less than 360°, about the rotation axis of the insertion depth operating element 72. The rotary disk element 118 likewise comprises a latching receiving region 128 (FIG. 3), which is realized to correspond to the latching receiving region 126 of the insertion depth operating element 72. The latching receiving region 126 of the insertion depth operating element 72 and the latching receiving region 128 of the rotary disk element 118 thus engage in each other when the insertion depth operating element 72 has been fixed to the rotary disk element 118 in a rotationally fixed manner. It is also conceivable, however, for at least one latching element of the adjustment unit 20 to be additionally disposed between the latching receiving regions 126, 128.

The latching receiving region 126 of the insertion depth operating element 72 and the latching receiving region 128 of the rotary disk element 118, as well as undoing of the rotationally fixed fixing of the insertion depth operating element 72 to the rotary disk element 118 for the purpose of enabling a relative movement of the insertion depth operating element 72 and of the rotary disk element 118, in this case enable a parallelity and/or a planarity of the workpiece contact surfaces 14, 16 to be adjusted relative to each other. Thus, the latching receiving region 126 of the insertion depth operating element 72 and the latching receiving region 128 of the rotary disk element 118, as well as a rotatable seating of the insertion depth operating element 72 on the rotary disk element 118, constitute a surface position adjustment unit 21 of the adjustment unit 20. The adjustment unit 20 thus comprises at least one surface position adjustment unit 21 that, for the purpose of adjusting the at least one movably mounted workpiece contact surface 16, at least the insertion depth operating element 72 and the rotary disk element 118, which are mounted so as to be movable relative to each other, at least in one state. An adjustment of an alignment of the movably mounted workpiece contact surface 16 can thus be rendered possible, according to the disclosed method, by means of the adjustment unit 20. In addition, it is also conceivable for the adjustment unit 20 to have, in addition to the surface position adjustment unit 21, at least one tilt setting unit, which is designed to adjust and/or compensate a tilt of the workpiece contact surfaces 14, 16 relative to each other. It is conceivable in this case that the movably mounted workpiece contact surface 16 can be moved, for example by means of two adjustment elements of the adjustment unit 20, disposed laterally on the movably mounted workpiece contact surface 16, such as, for example, by means of adjustment threaded bolts or by means of adjustment rods, in such a manner that it is possible to compensate a tilt about a tilt axis 23 of the movably mounted workpiece contact surface 16 that is at least substantially parallel to the movably mounted workpiece contact surface 16. Further designs of the adjustment unit 20, considered appropriate by persons skilled in the art, for adjusting a parallelity and/or a planarity of the workpiece contact surfaces 14, 16 relative to each other are likewise conceivable.

Furthermore, the adjustment unit 20 has at least one setting unit 22 (FIGS. 4 to 8), also referred to herein as a setting mechanism, which is designed to set a position of an insert tool bearing element 24 (FIGS. 5 and 6) of the insert tool unit 18 for the purpose of adjusting the alignment of the insert tool unit 18 relative to at least one of the workpiece contact surfaces 14, 16. The adjustment unit 20 in this case is designed to set a position of an insert tool bearing element 24 (FIGS. 5 and 6) of the insert tool unit 18 for the purpose of adjusting a parallelity of the insert tool unit 18, in particular of the insert tool axis 88 of the rotational element 106, relative to at least one of the workpiece contact surfaces 14, 16. The insert tool bearing element 24 is realized as an axle stub, on which the rotational element 106 of the insert tool unit 18 is mounted, in a manner already known to persons skilled in the art, in particular by means of an internal mounting, in which the rotational element 106 surrounds the axle stub. In this case, bearing elements such as, for example, rolling bearing elements and/or slide bearing elements of the insert tool unit 18 are arranged, in a manner already known to persons skilled in the art, for the purpose of mounting the rotational element 106 on the insert tool bearing element 24. The insert tool bearing element 24 is realized so as to be integral with a bearing bracket element 130 of the insert tool unit 18. It is also conceivable, however, for the insert tool bearing element 24 to be realized so as to be separate from the bearing bracket element 130, and to be fastened to the bearing bracket element 130 by means of a force-fit and/or form-fit connection. The rotational element 106, and thus the insert tool unit 18, is mounted in the power tool housing 70, on a side of the rotational element 106 that faces away from insert tool bearing element 24, realized as an axle stub, in a manner already known to persons skilled in the art. It is also conceivable, however, for the rotational element 106, and thus the insert tool unit 18, to be additionally mounted on the power tool housing 70 so as to be settable by means of the adjustment unit 20, on the side that faces away from the insert tool bearing element 24, realized as an axle stub.

Figure 4:
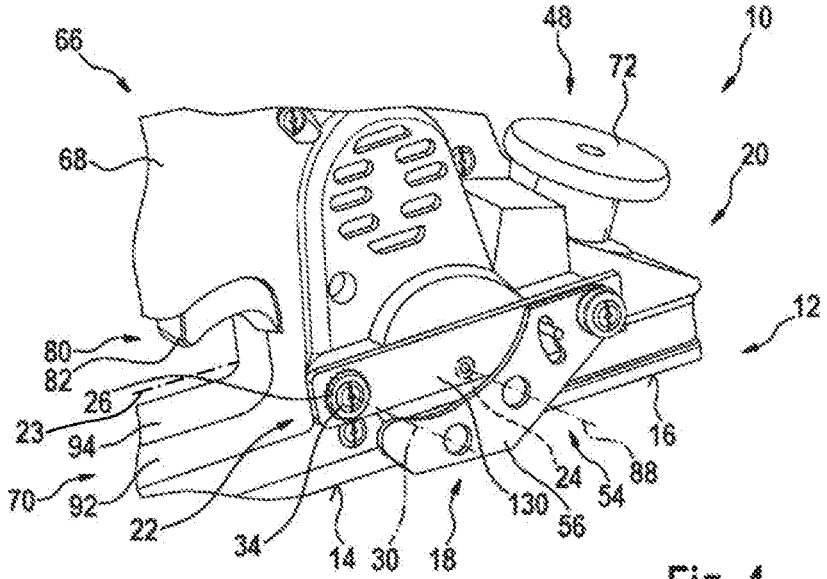

The bearing bracket element 130 can be fastened to the power tool housing 70 by means of at least one fastening element (FIG. 4). The bearing bracket element 130 can be disposed on at least one side of the power tool housing 70 that extends, at least substantially, transversely in relation to at least one of the workpiece contact surfaces 14, 16. In this case, when the hearing bracket element 130 has been disposed on the power tool housing 70, the bearing bracket element 130 can be fastened to the power tool housing 70, by means of the fastening element, at an end of the bearing bracket element 130 that faces toward the insertion depth setting unit 48. The fastening element is realized as a screw. It is also conceivable, however, for the fastening element for fastening the bearing bracket element 130 to be of a different design, considered appropriate by persons skilled in the art, such as, for example, designed as a spring latching element, as a bayonet closure element, as rivets, as clips, or the like. The bearing bracket element 130 is additionally rotatably mounted on the power tool housing 70, at an end of the bearing bracket element 130 that faces toward the insertion depth setting unit 48, by means of a bearing pin of the power tool housing 70 that engages in the bearing bracket element 130, and in which the fastening element engages for the purpose of fastening the bearing bracket element 130.

Figure 5:
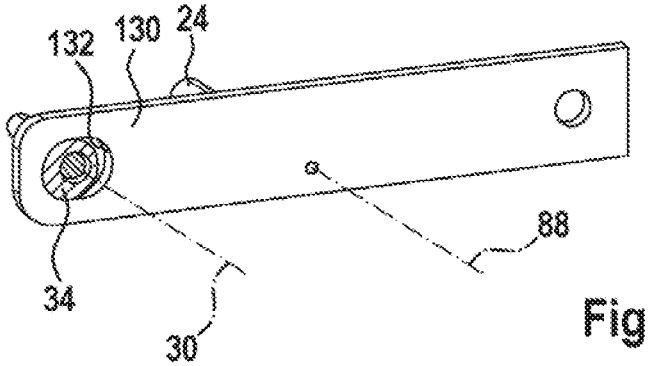
Figure 6:
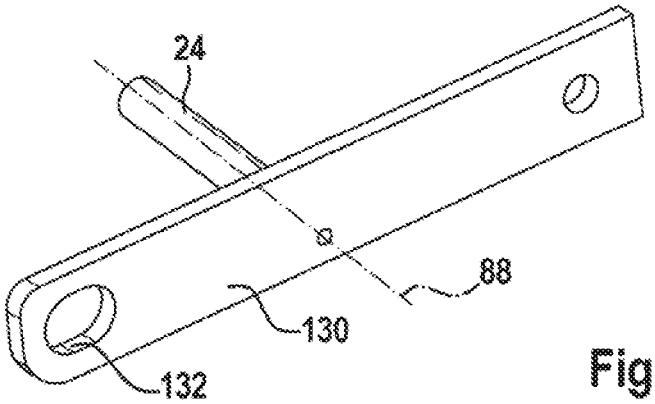
Figure 7:
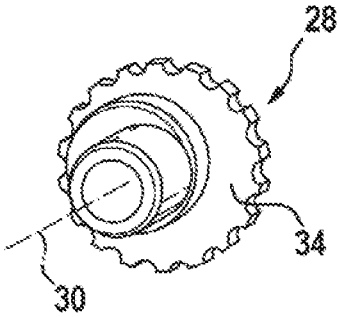
Figure 8:
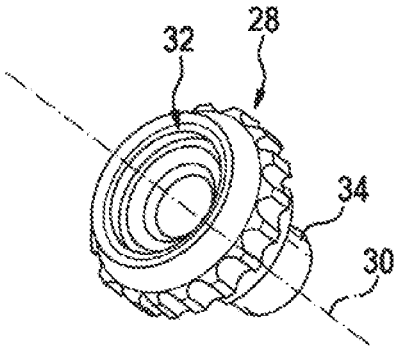

The setting unit 22, which is designed to set a position of the insert tool bearing element 24 for the purpose of adjusting the alignment of the insert tool unit 18 relative to at least one of the workpiece contact surfaces 14, 16, is realized as a cam mechanism. The setting unit 22 in this case has at least one eccentric element 26 (FIGS. 4, 5, 7 and 8) for setting the position of the insert tool bearing element 24. The eccentric element 26 engages in a cam mechanism element 132 of the setting unit 22 that is realized as a recess (FIG. 5). In this case, preferably, a cylindrical sub-region of the eccentric element 26 is disposed in a bearing recess (not represented in greater detail here) of the power tool housing 70 for the purpose of guiding the eccentric element 26 during a movement of the eccentric element 26. The cam mechanism element 132 that is realized as a recess is disposed on the bearing bracket element 130. The cam mechanism element 132 is realized as an elongate hole. The cam mechanism element 132 in this case is disposed at an end of the bearing bracket element 130 that faces away from the end of the bearing bracket element 130 by means of which the bearing bracket element 130 can be fastened to the fastening element on the power tool housing 70. When the bearing bracket element 130 has been disposed on the power tool housing 70, the end of the bearing bracket element 130 on which the cam mechanism element 132 is disposed is in this case disposed on a side of the bearing bracket element 130 that faces away from the insertion depth setting unit 48.

In addition, in at least one state, in particular when the eccentric element 26 is in a non-fixed state, the eccentric element 26 is rotatably mounted on the power tool housing 70. For the purpose of fixing the eccentric element 26 in at least one rotary position, the adjustment unit 20 has at least one fixing element 34. The fixing element 34 is realized as a screw. It is also conceivable, however, for the fixing element 34 to be of a different design, considered appropriate by persons skilled in the art, such as, for example, designed as a spring latching element, as a bayonet closure element, as rivets, as clips, or the like. The eccentric element 26 has at least one fixing element receiving region 32 (FIG. 8), which is designed to receive the fixing element 31 of the adjustment unit 20 that is designed to fix the eccentric element 26 in at least one position. The fixing element receiving region 32 is realized in such a manner that a screw head of the fixing element 34 that is realized as a screw can be disposed, at least mostly, in the fixing element receiving region 32, in particular can be sunk, at least mostly, in the fixing element receiving region 32.

The eccentric element 26 additionally has at least one actuation region 28 (FIGS. 7 and 8), which is disposed on the eccentric element 26, symmetrically in relation to a movement axis 30 of the eccentric element 26. The actuation region 28 in this case surrounds the fixing element receiving region 32. The actuation region 28 in this case may be designed for manual actuation by an operator, or the actuation region 28 may be designed for tool actuation, in which an actuating tool, realized to correspond to the actuation region 28, can be connected to the actuation region 28. The actuation region 28 is disposed on the eccentric element 26 such that it is contiguous with an eccentric region of the eccentric element 26. The eccentric region is disposed in the cam mechanism element 132 that is realized as an elongate hole. The eccentric region in this case is disposed on the eccentric element 26, eccentrically in relation to the movement axis 30 of the eccentric element 26. A position of the bearing bracket element 130 relative to the power tool housing 70 can thus be altered as a result of a rotary movement of the eccentric element 26. As a result of this, the bearing bracket element 130 can be rotated about a rotation axis that is constituted by a longitudinal axis of the fastening element by means of which the bearing bracket element 130 can be fastened to the power tool housing 70. As a result of this, the insert tool bearing element 24, together with the rotational element 106, can be moved, in particular tilted, relative to at least one of the workpiece contact surfaces 14, 16. Thus, advantageously, an alignment of the insert tool unit 18 relative to at least one of the workpiece contact surfaces 14, 16 can be adjusted. It is conceivable in this case that a respective dial gauge, by means of which it is possible to check an alignment, can be disposed on at least one of the workpiece contact surfaces 14, 16 and on the insert tool unit 18. As soon as an alignment has been effected, the bearing bracket element 130, and thus the insert tool bearing element 24, can be fixed in a position. According to a procedure according to the method described above, an alignment of the insert tool unit 18 and/or of the at least one workpiece contact surface 16 can be adjusted.

Furthermore, the portable power tool 10 comprises at least one insert tool contact protection unit 54, which has at least one contact protection element 56, which is disposed on the adjustment unit 20. In at least one state, in particular when the contact protection element 56 is in a non-fixed state, the contact protection element 56 is mounted in a movable manner on the adjustment unit 20. The contact protection element in this case is connected, by one end, to the fastening element by means of which the bearing bracket element 130 can be fastened to the power tool housing 70. The contact protection element 56 is additionally disposed on the bearing pin of the power tool housing 70 that engages in the bearing bracket element 130.

The insert tool contact protection unit 54 additionally comprises at least one movement limiting element, which is designed to limit a maximum movement distance of the contact protection element 56 relative to the power tool housing 70. The movement limiting element in this case is realized as a pin, which is disposed on the bearing bracket element 130. For the purpose of limiting a maximum movement distance of the contact protection element 56, the movement limiting element engages in a movement limiting recess of the contact protection element 56. It is also conceivable, however, for the insert tool contact protection unit. 54 to have at least two movement limiting elements, which, for example, are disposed on the bearing bracket element 130 and between which the contact protection element 56 can be moved along a maximum movement distance. Further designs, considered appropriate by persons skilled in the art, are likewise conceivable.

The invention claimed is:

1. A portable power tool, comprising:

an adjustable first workpiece contact surface defining a first surface plane;

a second workpiece contact surface defining a second surface plane;

an insert tool projecting at least partially beyond the first surface plane in order to perform work on a workpiece;

an insertion depth operating element; and a rotary disk element, wherein, in a first state, the insertion depth operating element is configured to be fixed to the rotary disk element such that the insertion depth operating element corotates with the rotary disk element, the insertion depth operating element and the rotary disk element configured to cooperate in the first state so as to adjust an alignment of the first workpiece contact surface relative to the insert tool and the second workpiece contact surface, and wherein, in a second state, the insertion depth operating element is not fixed to the rotary disk element such that the insertion depth operating element is movable relative to the rotary disk element.

2. The portable power tool as claimed in claim 1, further comprising:

a guide arrangement configured to cooperate with the insertion depth operating element and the rotary disk element to limit the first workpiece contact surface to one degree of freedom of movement.

3. The portable power tool as claimed in claim 2, wherein:

the first workpiece contact surface is configured to be adjustable along a movement axis; and the guide arrangement includes at least one anti-rotation element configured to cooperate with the insertion depth operating element and the rotary disk element to secure the first workpiece contact surface against rotation about the movement axis.

4. The portable power tool as claimed in claim 2, further comprising:

an insertion depth setting element; and at least one play avoidance element configured to cooperate with the insertion depth setting element to avoid, at least substantially, a movement play of the insertion depth setting element.

5. The portable power tool as claimed in claim 4, wherein the play avoidance element is configured to apply a clamping force to the insertion depth setting element along a direction that is substantially transverse to a movement axis of the insertion depth setting element to avoid, at least substantially, the movement play of the insertion depth setting element.

6. The portable power tool as claimed in claim 1, further comprising:

at least one contact protection element disposed on a power tool housing of the portable power tool in which the insert tool is at least partially housed and to which the adjustable first workpiece contact surface, the second workpiece contact surface, the insertion depth operating element, and the rotary disk element are connected.

7. The portable power tool as claimed in claim 1, wherein the portable power tool is configured as a hand-held power planer.

8. The portable power tool as claimed in claim 1, wherein, in the first state, the corotation of the insertion depth operating element and the rotary disk element adjusts the first workpiece contact surface relative to an insert tool axis of the insert tool in order to set a planing depth of the power tool.

9. The portable power tool as claimed in claim 1, wherein, in the second state, the rotary disk element is configured to adjust the first workpiece contact surface relative to an insert tool axis of the insert tool.

10. The portable power tool as claimed in claim 1, wherein:

the insert tool defines an insert tool axis; and the portable power tool further comprises a setting mechanism configured to adjust an alignment of the insert tool axis relative to one of the first workpiece contact surface and the second workpiece contact surface.

11. A hand-held power planer, comprising:

a first workpiece contact surface defining a first surface plane;

an adjustable insert tool defining an insert tool axis and projecting at least partially beyond the first surface plane in order to perform work on a workpiece; and a setting mechanism configured to adjust an alignment of the insert tool axis relative to the first workpiece contact surface.

12. The hand-held power planer as claimed in claim 11, wherein:

the insert tool includes an insert tool bearing element; and the setting mechanism is configured to set a position of the insert tool bearing element in order to adjust the alignment of the insert tool axis.

13. The hand-held power planer as claimed in claim 12, wherein the setting mechanism includes a cam mechanism configured to adjust the alignment of the insert tool axis.

14. The hand-held power planer as claimed in claim 13, wherein:

the setting mechanism includes an eccentric element and a cam mechanism element; and the eccentric element is arranged within the cam mechanism element such that rotation of the eccentric element adjusts the position of the insert tool bearing element.

15. The hand-held power planer as claimed in claim 14, wherein:

the eccentric element includes an actuation region disposed on the eccentric element symmetrically in relation to a rotation axis of the eccentric element; and the actuation region is configured to be actuated so as to rotate the eccentric element.

16. The hand-held power planer as claimed in claim 15, wherein:

the setting mechanism further includes a fixing element; and the eccentric element includes a fixing element receiving region configured to receive the fixing element so as to fix the eccentric element in at least one eccentric position.

* * * * *